US007789031B2

(12) United States Patent
Kim

(10) Patent No.: US 7,789,031 B2
(45) Date of Patent: Sep. 7, 2010

(54) VESSEL INCLUDING AUTOMATIC BALLAST SYSTEM USING TUBES

(76) Inventor: Yong-Kyung Kim, 114-4, Dundeog-Ri, Seongsan-Myeon, Kunsan-City, KO (KR) 573-897

( * ) Notice: Subject to any disclaimer, the term of this patent is extended or adjusted under 35 U.S.C. 154(b) by 781 days.

(21) Appl. No.: 11/597,858

(22) PCT Filed: Apr. 26, 2005

(86) PCT No.: PCT/KR2005/001194

§ 371 (c)(1),
(2), (4) Date: Nov. 28, 2006

(87) PCT Pub. No.: WO2005/118387

PCT Pub. Date: Dec. 15, 2005

(65) Prior Publication Data

US 2009/0194011 A1 Aug. 6, 2009

(30) Foreign Application Priority Data

Jun. 2, 2004 (KR) ..... 10-2004-0039954

(51) Int. Cl.
*B63B 43/04* (2006.01)

(52) U.S. Cl. ..... 114/74 A; 114/74 R

(58) Field of Classification Search ..... 114/121, 114/125, 74 R, 74 A
See application file for complete search history.

(56) References Cited

U.S. PATENT DOCUMENTS 4,117,796 A 10/1978 Strain
4,648,342 A * 3/1987 Collins et al. ..... 114/40
5,203,828 A 4/1993 Strain

FOREIGN PATENT DOCUMENTS

KR 84-1547 B 10/1984

* cited by examiner

*Primary Examiner*—Edwin Swinehart
(74) *Attorney, Agent, or Firm*—Law Office of T. S. Choo, PLC; Tai-Sam Choo

(57) ABSTRACT

A double-hulled vessel has a ballast draft line previously set at an empty state thereof. The double-hulled vessel of the present invention comprises an outer shell formed on bottom and side portions of the vessel; an inner shell formed on bottom and side portions of the vessel within the outer shell; an air tube positioned between the inner and outer shells; and a seawater tube positioned between the inner and outer shells, wherein seawater holes are formed in the outer shell to be connected to the seawater tube, the seawater tube is capable of containing seawater to substantially fill a space between the inner and outer shells extending from the bottom portion of the vessel up to the ballast draft line of the side portion of the vessel when the vessel is not loaded with cargo, and the air tube is capable of containing air to substantially fill the space between the inner and outer shells of the bottom and side portions of the vessel when the vessel is loaded with cargo.

7 Claims, 3 Drawing Sheets

VESSEL INCLUDING AUTOMATIC BALLAST SYSTEM USING TUBES

TECHNICAL FIELD

The present invention relates to a vessel, and more particularly, to a vessel including a seawater ballast system, such as an oil tanker or an LNG tanker.

BACKGROUND ART

Generally, ballast refers to weight loaded on a vessel for the stabilization of the hull. A vessel is provided with a ballast system to minimize trim/heel phenomena and provide the vessel with stabilization such that the vessel does not overturn due to wind and wave actions. For example, a vessel such as a cargo vessel is provided with a ballast tank. The vessel arrives at a port for loading cargo in a state where the ballast tank is filled with seawater. Then, the vessel is loaded with cargo and leaves for a destination port after the seawater ballast has been discharged to the outside.

Solid powder or solid materials with high specific gravity are sometimes used as ballast, but water is generally used because water can be easily obtained near the vessel. Thus, most vessels include a ballast tank, i.e. a ballast system, which corresponds to a container containing seawater as a ballast material. Accordingly, vessels have also been equipped with pumps as a means for causing the container to be filled with seawater, and fluid devices such as pipelines for transferring the seawater to the container and valves for regulating the pipelines.

Meanwhile, mandatory rules for double-hulled vessels have been recently introduced due to serious marine pollution caused by the collision or stranding of vessels. Accordingly, a ballast tank is installed in a space between an outer shell and an inner shell defining a cargo bay.

Such a seawater ballast system for use in the conventional vessels needs to be further improved.

A vessel operates pumps and pipelines to contain ballast seawater in the vessel to a certain degree that the buoyancy influence on the entire hull can be canceled out. However, such a system has a problem that excessive working expenses due to frequent power loss, pump damage, the exchange of pipes and the like should be unnecessarily spent.

In addition, the seawater filled in the ballast tank of the vessel includes many microorganisms and is carried to the next port of discharge in such a state. To load cargo, the filled seawater is pumped out at the port of discharge. At this time, there is a problem that the microorganisms included in the seawater may cause serious changes in the ecological system of microorganisms living around the port of discharge. A variety of suggestions for solving the aforementioned problem have been provided, but they are relatively ineffective. Further, many countries have newly establish various kinds of regulations for solving the aforementioned problem.

The ballast tank is easily corroded on its surface exposed to the seawater filled therein, which may make the hull weaker. Due to this corrosion, the painting operation of the interior of the vessel and the exchange of steel plates of the vessel should be frequently performed, which may cause a great deal of repair and maintenance costs. Further, the seawater contaminated by the corrosion may have a serious negative influence on the marine environment.

In particular, it is very important that when the vessel is damaged, conventional methods cannot ensure the restoration and survival chance of the damaged vessels. For this reason, many mandatory regulations for the double-hull structure of vessels have been enforced. However, even in such a case, the restoration and survival chance of the vessel are very low, and thus, the resultant damage to the vessel is unimaginably serious.

DISCLOSURE OF INVENTION

Technical Problem

Accordingly, the present invention is conceived to solve the problems in the prior art. An object of the invention is to provide a vessel which has an automatic ballast function by causing seawater holes to be opened for the introduction of seawater into a vessel under sail without cargo, and which has little influence on seawater near a port for loading cargo by causing the seawater to naturally flow and thus preventing the pollution due to ballast water.

Another object of the present invention is to provide a vessel including a tube for preventing introduced seawater from coming into direct contact with an inner shell of the vessel, thereby minimizing corrosion of vessel structures.

A further object of the present invention is to provide a vessel with an additional tube used to discharge the seawater introduced into the tube. More specifically, the introduced seawater can be discharged out of the vessel by pumping compressed air into the tube. This function can be achieved by means of the weight or compression force of cargo loaded in the vessel. That is, the object of the present invention is to provide a vessel including a seawater tube and a compressed air tube which interact with each other.

A still further object of the present invention is to provide a vessel with improved restoration and survival characteristics, wherein the air tube is filled with compressed air when cargo is loaded, so that the amount of seawater introduced into the vessel due to hull damage is minimized when any probable impact is applied to the side or bottom of the vessel.

Technical Solution

According to an aspect of the present invention for achieving the objects, there is provided a double-hulled vessel whose ballast draft line is previously set at an empty state thereof. The double-hulled vessel of the present invention comprises an outer shell formed on bottom and side portions of the vessel; an inner shell formed on bottom and side portions of the vessel within the outer shell; an air tube positioned between the inner and outer shells; and a seawater tube positioned between the inner and outer shells, wherein seawater holes are formed in the outer shell to be connected to the seawater tube, the seawater tube is capable of containing seawater to substantially fill a space between the inner and outer shells extending from the bottom portion of the vessel up to the ballast draft line of the side portion of the vessel when the vessel is not loaded with cargo, and the air tube is capable of containing air to substantially fill the space between the inner and outer shells of the bottom and side portions of the vessel when the vessel is loaded with cargo.

Preferably, an opening/closing device is provided at the seawater holes.

More preferably, the space between the inner and outer shells is divided into a bottom tank and a side tank, the air tube includes a bottom air tube installed in the bottom tank and a side air tube installed in the side tank, and the seawater tube includes a bottom seawater tube installed in the bottom tank and a side seawater tube installed in the side tank.

An air tube may be further installed in a cargo tank defined within the inner shell to be connected to at least one of the air tubes positioned between the inner and outer shells.

The seawater holes may be configured to supply seawater into at least two partitioned spaces between the inner and outer shells.

According to another aspect of the present invention, there is provided a method for controlling a ballast draft line in a double-hulled vessel at an empty state of the vessel, comprising the steps of providing a vessel including air and seawater tubes between inner and outer shells, the seawater tube being connected to a seawater hole formed on the outer shell; opening the seawater hole, when the vessel is not loaded with cargo, to allow seawater to be introduced into the seawater tube for the control of the ballast draft line; and supplying air into the air tube, when the vessel is loaded with cargo, to allow the seawater contained in the seawater tube to be discharged out of the vessel.

The method of the present invention may further comprise the step of closing the seawater hole when the vessel is loaded with cargo.

ADVANTAGEOUS EFFECTS

According to the present invention so configured, all the objects of the present invention can be achieved. By using the above configuration, buoyancy is applied not to the outer shell of a vessel but to the outer shell of the cargo tank of the vessel. Thus, since a desired ballast draft line can be easily ensured, a variety of devices for introducing or discharging ballast do not have to be used. Further, since seawater is not confined in the vessel, the seawater can be freely introduced and discharged while the vessel is sailing, whereby the contamination of seawater or adverse effects due to the transport of microorganisms from one port to another can be minimized. Furthermore, since the area where seawater is brought into direct contact with the inner shell of the vessel is very small, vessel repair and maintenance costs caused by the corrosion or painting operation of a vessel hull can be markedly reduced. Moreover, impact on the vessel hull can be reduced even when the vessel is damaged at sea.

The above effects will be again described in detail. That is, the most advantageous effect of the present invention is that the restoration and survival chance of the vessel hull can be kept at a higher level even when the vessel is damaged. In a case where an empty vessel is damaged, impact applied to the vessel hull is minimized because seawater can be freely introduced and discharged. In such a case, if compressed air is introduced into air tubes and kept at a desired level, the draft line of the vessel hull is not substantially changed. Obviously, the draft line is kept substantially identical to a case where the vessel hull is not damaged.

Further, even if a vessel is damaged at a fully loaded state, the impact applied to the hull can be absorbed by compressed air tubes. Therefore, damage to the vessel hull is minimized and seawater is not substantially introduced into the vessel. There is a great advantage in maintaining the survival and restoration of the vessel hull. That is, the possibility that the vessel overturns or sinks can be greatly reduced.

Another effect of the present invention is that there is no contamination of seawater caused by ballast. Since seawater is not confined as ballast, it can be freely introduced and discharged. Thus, there is an advantage in that microorganisms in other regions have no influence on the marine environment at a specific region. For example, the present invention satisfies the requirements provided in the National Invasive Species Act (P.L. 104-332) that was enacted for preventing proliferation and invasion of organic matters into U.S. territorial waters via ballast of commercial vessels. Further, the present invention also solves many problems related to the above requirements.

A further effect of the present invention is that the cost of vessel repair is greatly reduced because the corrosion and painting operation of the vessel hull are markedly decreased. The reason is that since the seawater tubes prevent the vessel hull from being brought into contact with the seawater, the interior of the ballast tank can be easily kept dry.

A still further effect of the present invention is that costs due to the operation of the ballast system can be reduced. Since the ballast tank can be freely opened and closed, a need for the ballast system is reduced, and thus, the operation costs of the ballast system are similarly reduced.

A still further effect of the present invention is that efficiency of operating the vessel can be increased. Since a variety of cargo can be carried in turns using a cargo tank tube, the reciprocating operation can be performed, thereby increasing profits of shipping companies and reducing ocean freight costs.

In addition, the present invention is configured in such a manner that the compressed air tubes connected to the seawater tubes are placed in the ballast tank so that the seawater introduced into the ballast tank can be forcibly discharged to the outside. If the compressed air is maintained in the air tubes at a desired level using a compressed air supply device, i.e. an air compressor, already installed in the vessel, the restoration and survival chance of a damaged vessel can be greatly improved and a lot of impact can be absorbed even when the impact is applied to the vessel hull.

Consequently, the present invention eliminates the adverse effects of the existing ballast while satisfying requirements for the ballast. Therefore, inconsistent problems of existing ballast can be solved.

BRIEF DESCRIPTION OF THE DRAWINGS

The above and other objects and features will be more apparent to those skilled in the art through the description of the following embodiments of the present invention with reference to the accompanying drawings.

FIGS. 3 and 4 are vertical sectional views showing the vessel of FIG. 1, in which FIG. 3 shows an empty state of the vessel and FIG. 4 shows a fully loaded state of the vessel.

BEST MODE FOR CARRYING OUT THE INVENTION

Figure 1:
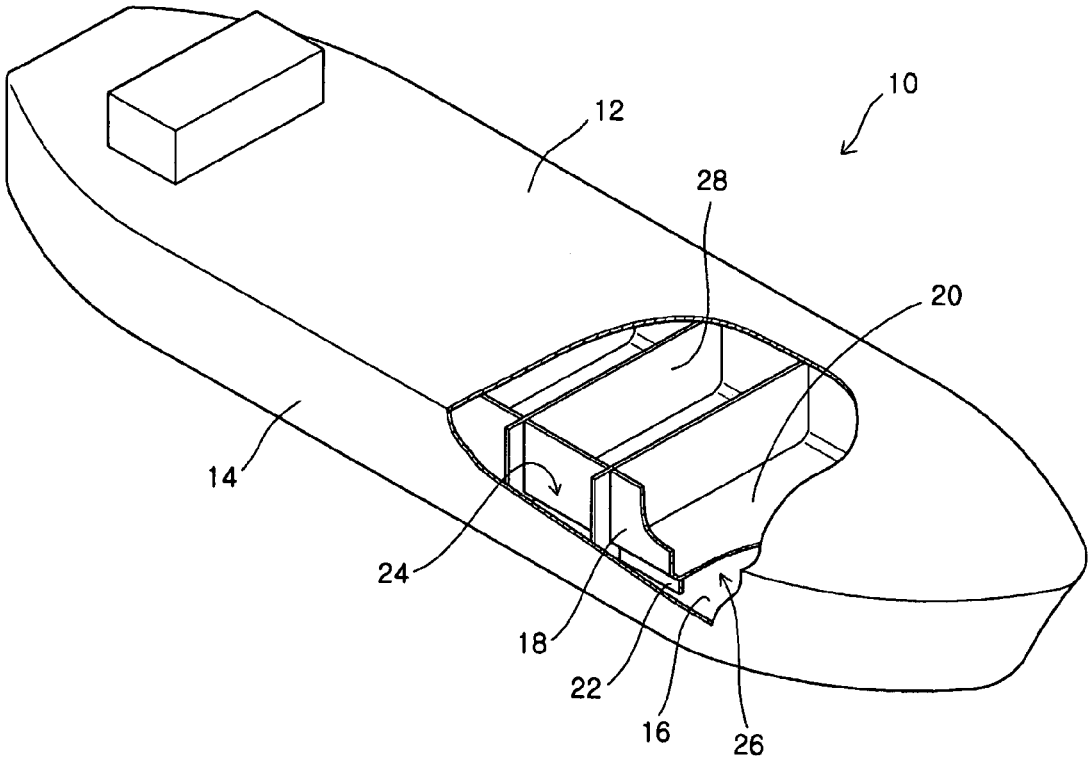
FIG. 1 is a perspective view showing a vessel according to an embodiment of the present invention, in which a deck, an outer side shell, an inner bottom hull and an inner side shell are partially cut away.

The hull structure of a vessel defines the outline or framework of the vessel and is commonly formed by installing long reinforcing members to a plate member. FIG. 1 shows an example of a hull structure of a vessel according to an embodiment of the present invention. Although reinforcing members are omitted and not shown in the figures herein, those skilled in the art will understand that a variety of reinforcing members such as a keel and a stiffener can be installed at proper positions.

Figure 2:
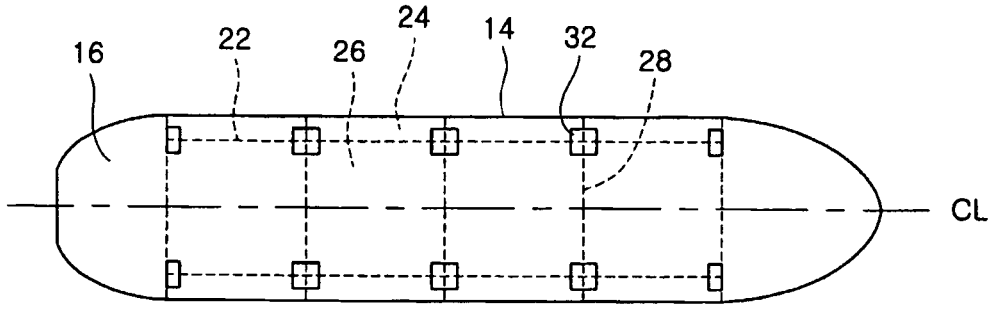
FIG. 2 is a bottom view of the vessel of FIG. 1, in which a seawater circulation device of the vessel is shown.

Referring to FIGS. 1 and 2, a double-hulled vessel 10 of the embodiment according to the present invention includes a deck 12, an outer side shell 14, and an outer bottom shell 16. Further, the vessel 10 includes an inner side shell 18 and an inner bottom shell 20 which are placed within the outer shells 14 and 16, respectively. The vessel 10 also includes cross bulkheads 28 traversing the vessel in a lateral direction. By means of the cross bulkheads 28, an inner space defined by the inner shells 18 and 20 and a space defined between the inner shells 18 and 20 and the outer shells 14 and 16 are partitioned. Each of the partitioned spaces defined in the inner shells 18 and 20 becomes a cargo tank 30. Further, each of the partitioned spaces defined between the inner shells 18 and 20 and the outer shells 14 and 16 is divided into two spaces by means of a tank bulkhead 22. The partitioned space positioned near the side of the vessel is called a side tank 24 (referred to as a wing tank), and the partitioned space positioned near the bottom of the vessel is called a bottom tank 26. Meanwhile, in another modification, the vessel may further include a wall extending along the centerline CL in a longitudinal direction.

Referring to FIG. 2, a plurality of seawater holes 32 are provided in the bottom of the vessel. Each of the seawater holes 32 is connected in common to a side seawater tube and a bottom seawater tube (to be descried in detail later), which are prepared in the side tank 24 and the bottom tank 26, respectively. However, the present invention is not limited thereto. Each of the tubes may be connected to an individual seawater hole 32. An opening/closing device 35 is provided in each of the seawater holes 32 (see FIGS. 3 and 4). The opening/closing device of the present invention is not limited to those illustrated in FIGS. 3 and 4, and those skilled in the art will understand that such an opening/closing device can be properly configured in a different manner from those illustrated in FIGS. 3 and 4.

Figure 3:
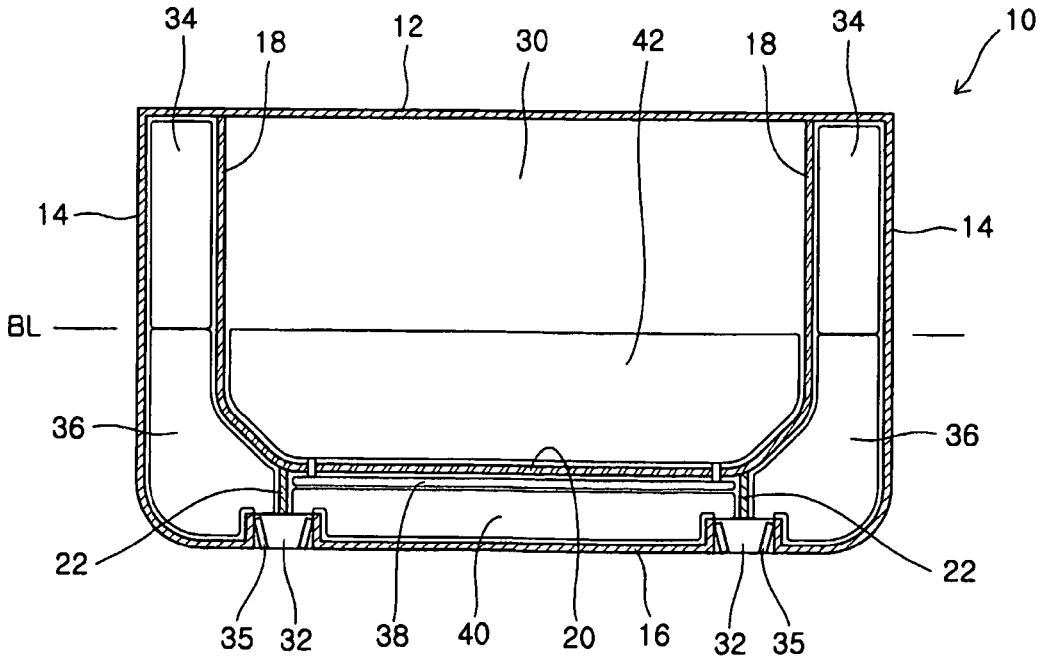
Figure 4:
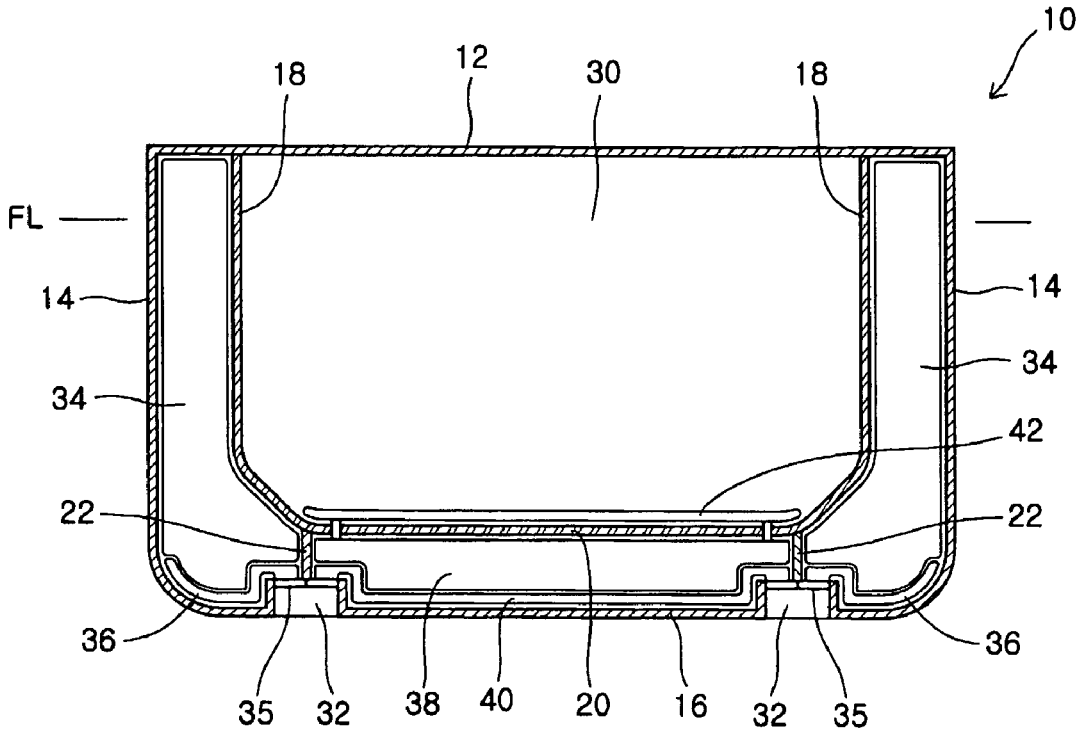

Referring to FIGS. 3 and 4, the side tank 24 is provided with a side air tube 34 and a side seawater tube 36. As shown in FIG. 3, the side seawater tube 36 is preferably sized to fully fill the space of the side tank 24 below a ballast draft line BL set to a desired design height when seawater inflow is maximized. As shown in FIG. 4, the side air tube 34 is preferably sized to fully fill the side tank 24 when compressed air inflow is maximized.

Furthermore, the bottom tank 26 is provided with a bottom air tube 38 and a bottom seawater tube 40. As shown in FIG. 3, the bottom seawater tube 40 is preferably sized to fully fill the bottom tank 26 when seawater inflow is maximized. As shown in FIG. 4, the bottom air tube 38 is preferably sized to fully fill the bottom tank 26 when compressed air inflow is maximized.

Meanwhile, the cargo tank 30 is provided with a cargo tank air tube 42. The cargo tank air tube 42 is sized to fill the cargo tank 30 up to the ballast draft line BL from the cargo tank bottom when compressed air fully fills the tube, as shown in FIG. 3. However, the present invention is not limited thereto.

Although it has not been shown in detail in FIGS. 3 and 4, the cargo tank air tube 42 is connected to the side air tube 34 and the bottom air tube 38. Thus, when the cargo tank air tube 42 is pressed by cargo, the compressed air in the tube 42 can be moved to the side air tube 34 and the bottom air tube 38. At this time, the air tubes are preferably connected to a compressed air supply device (not shown). On the other hand, the cargo tank air tube 42 may be connected only to the bottom air tube 38, and the side air tube 34 may be connected only to the compressed air supply device.

The tubes may be made of surface-treated materials so as to be suitable for fluid to be filled therein or reinforced materials. The seawater tubes are made of waterproof materials. Further, the tubes may be made by cutting materials that have low flexibility but can be easily folded or unfolded. On the other hand, those skilled in the art will also understand that the tubes may be made of materials that are flexible and can thus be expanded or contracted.

In addition, although it has not been shown in detail herein, the vessel 10 includes a water discharge device which is connected the side seawater tube 36 and the bottom seawater tube 40. The water discharge device includes a separate discharge port (not shown) in addition to a discharge pipe.

Hereinafter, the operation of the ballast system of the vessel 10 according to the embodiment of the present invention will be described with reference to FIGS. 3 and 4. In a state where cargo is not loaded in a vessel, the opening/closing devices 35 of the seawater holes 32 are manipulated to open the seawater holes 32, as shown in FIG. 3. Then, seawater is introduced into the bottom seawater tube 40 and the side seawater tube 36, respectively. The seawater is introduced into the bottom seawater tube 40 and almost fully fills the bottom tank 26. Further, seawater is introduced into the side seawater tube 36 and almost fully fills the side tank 24 below the ballast draft line BL. Then, buoyancy is substantially applied to the inner shells of the vessel, and thus, the ballast draft line can be ensured. At this time, air is removed from the bottom and side air tubes 38 and 34 to the cargo tank air tube 42. The air is completely discharged from the bottom air tube 38, but still remains in a space of the side air tube 34 above the ballast draft line BL.

When the vessel is under sail without cargo, the seawater holes are always open. Thus, seawater can freely flow into or out of the tubes through the seawater holes. Therefore, the tubes are always filled with local seawater where the vessel is sailing.

Next, the operation of the ballast system performed when the vessel is fully loaded with cargo will be described. First, the seawater holes are closed. Then, if cargo such as LNG or crude oil is filled in the cargo tank 30, the cargo tank air tube 42 is pressed down and the air therein is introduced and filled into the bottom and side air tubes 38 and 34. Thus, the bottom and side tanks 26 and 24 are almost occupied by the bottom and side air tubes 38 and 34, respectively. At this time, in a case where an amount of air is not sufficient, a compressed air supply device (e.g., a compressed air pump) is operated to adequately supply air into the tubes. Meanwhile, the seawater in the seawater tubes 36 and 40 are discharged out of the vessel 10 through the discharge port via the discharge pipe. This state is well shown in FIG. 4.

The present invention is not limited to the embodiment including the aforementioned hull structure of the vessel. For example, air may be supplied to the respective air tubes by means of a compressed air supply device (e.g., an air compressor generally installed in the vessel) without use of the cargo tank air tube. At this time, an additional air exhaust device can be used. In another modification, the bottom and side tanks may communicate with each other, and the bottom tank may be divided at the center thereof.

Although the present invention has been described in connection with the embodiment, it is not limited thereto. It can be understood by those skilled in the art that various modifications and changes can be made thereto without departing from the spirit and scope of the present invention and such modifications and changes fall within the scope of the present invention.

The invention claimed is:

1. A double-hulled vessel whose ballast draft line is previously set at an empty state thereof, comprising:

an outer hull formed on bottom and side portions of the vessel by two outer side shells and a bottom outer shell;

an inner hull formed on bottom and side portions of the vessel within the outer hull by two inner side shells and a inner bottom shell;

a plurality of cross bulkheads traversing the vessel in a lateral direction, a plurality of tank bulkheads positioned between the inner and outer bottom shells near the side of vessel along the length thereof;

a plurality of cargo tanks formed by two bulkheads, two inner side shells and the inner bottom shell;

a plurality of side tanks positioned near the side of the vessel between the inner and outer hull formed by two cross bulkheads, inner and outer side shells and a tank bulkhead;

a plurality of bottom tanks positioned near the bottom of the vessel formed by two tank bulkheads and inner and outer bottom shells;

a plurality of side air tubes, which can be expanded or contracted, having openings for air flow, being positioned within each side tank of the vessel, and capable of containing air to substantially fill the entire space of each side tank, when the vessel is loaded with cargo;

a plurality of side seawater tubes, which can be expanded or contracted, having openings for seawater flow, being positioned underneath the side air tubes within each side tank of the vessel, and capable of containing seawater to substantially fill the space in each side tank from the bottom portion of the vessel and up to the ballast draft line, when the vessel is not loaded with cargo;

a plurality of bottom air tubes, which can be expanded or contracted, having openings for air flow, being positioned within each bottom tank of the vessel, and capable of containing air to substantially fill the entire space of each bottom tank, when the vessel is loaded with cargo;

a plurality of bottom seawater tubes, which can be expanded or contracted, having openings for seawater flow, being positioned underneath the bottom air tubes within each bottom tank of the vessel, and capable of containing seawater to substantially fill the space in each bottom tank when the vessel is not loaded with cargo; and a plurality of seawater holes formed in the outer bottom shell to be connected to the side and bottom seawater tubes to allow the flow of seawater;

wherein the preset ballast draft line is maintained by regulating the air supply to air tubes within the side and bottom tanks, which supply causes the expansion and contraction of the air tubes, which, in turn, causes the corresponding contraction and expansion of the seawater tubes to regulate the amount of seawater contained therein.

2. The double-hulled vessel as claimed in claim 1, wherein an opening/closing device is provided at the seawater holes.

3. The double-hulled vessel as claimed in claim 1, wherein each cargo tank has positioned at the inner bottom shell thereof a cargo air tube, which can be expanded or contracted, having at least one opening for air flow, and being sized to fill the cargo tank up to the ballast draft line from the inner bottom shell thereof when fully filled using compressed air introduced through the opening.

4. The double-hulled vessel as claimed in claim 3, wherein each cargo air tube is connected to the corresponding side air tube and the bottom air tube.

5. The double-hulled vessel as claimed in any of claims 1 to 3, wherein the seawater holes are configured to supply seawater into at least two sea water tanks.

6. A method for controlling a ballast draft line in a double-hulled vessel set at an empty state thereof, comprising the steps of: providing an outer hull formed on bottom and side portions of the vessel by two outer side shells and a bottom outer shell;

an inner hull formed on bottom and side portions of the vessel within the outer hull by two inner side shells and a inner bottom shell;

a plurality of cross bulkheads traversing the vessel in a lateral direction, a plurality of tank bulkheads positioned between the inner and outer bottom shells near the side of vessel along the length thereof;

a plurality of cargo tanks formed by two bulkheads, two inner side shells and the inner bottom shell;

a plurality of side tanks positioned near the side of the vessel between the inner and outer hull formed by two cross bulkheads, inner and outer side shells and a tank bulkhead;

a plurality of bottom tanks positioned near the bottom of the vessel formed by two tank bulkheads and inner and outer bottom shells;

a plurality of side air tubes, which can be expanded or contracted, having openings for air flow, being positioned within each side tank of the vessel, and capable of containing air to substantially fill the entire space of each side tank, when the vessel is loaded with cargo;

a plurality of side seawater tubes, which can be expanded or contracted, having openings for seawater flow, being positioned underneath the side air tubes within each side tank of the vessel, and capable of containing seawater to substantially fill the space in each side tank from the bottom portion of the vessel and up to the ballast draft line, when the vessel is not loaded with cargo;

a plurality of bottom air tubes, which can be expanded or contracted, having openings for air flow, being positioned within each bottom tank of the vessel, and capable of containing air to substantially fill the entire space of each bottom tank, when the vessel is loaded with cargo;

a plurality of bottom seawater tubes, which can be expanded or contracted, having openings for seawater flow, being positioned underneath the bottom air tubes within each bottom tank of the vessel, and capable of containing seawater to substantially fill the space in each bottom tank when the vessel is not loaded with cargo; and a plurality of seawater holes formed in the outer bottom shell to be connected to the side and bottom seawater tubes to allow the flow of seawater;

opening the seawater holes, when the vessel is not loaded with cargo, to allow seawater to be introduced into the seawater tubes for the control of the ballast draft line; and supplying air into the air tubes, when the vessel is loaded with cargo, to allow the seawater contained in the seawater tube to be discharged out of the vessel.

7. The method as claimed in claim 6, further comprising the step of: closing the seawater holes when the vessel is loaded with cargo.

* * * * *